US006407035B1

(12) United States Patent
Austin et al.

(10) Patent No.: US 6,407,035 B1
(45) Date of Patent: Jun. 18, 2002

(54) COPYABLE CARBONLESS PAPER

(75) Inventors: Robert A. Austin; Bruce A. Neeld, both of Chillicothe; Peter C. Yao, Pickerington, all of OH (US)

(73) Assignee: The Mead Corporation, Dayton, OH (US)

( * ) Notice: Subject to any disclaimer, the term of this patent is extended or adjusted under 35 U.S.C. 154(b) by 98 days.

(21) Appl. No.: 09/624,159

(22) Filed: Jul. 24, 2000

Related U.S. Application Data

(60) Provisional application No. 60/145,406, filed on Jul. 23, 1999.

(51) Int. Cl.[7] ..... B41M 5/132; B41M 5/30
(52) U.S. Cl. ..... 503/201; 430/32; 503/207
(58) Field of Search ..... 430/32; 503/201, 503/207

(56) References Cited

U.S. PATENT DOCUMENTS

| | | | | |
|---|---|---|---|---|
| 4,906,605 | A | 3/1990 | Kraft | 503/215 |
| 5,084,433 | A | 1/1992 | Kraft | 503/201 |
| 5,223,473 | A | 6/1993 | Oliver et al. | 503/226 |
| 5,525,572 | A | 6/1996 | Williams | 503/201 |
| 5,709,976 | A | 1/1998 | Malhotra | 430/124 |
| 5,885,678 | A | 3/1999 | Malhotra | 428/41.8 |

*Primary Examiner*—Bruce H. Hess
(74) *Attorney, Agent, or Firm*—Thompson Hine LLP

(57) ABSTRACT

A method for printing carbonless forms on an electrostatic printer or copier and carbonless forms for use in electrostatic printers or copiers are disclosed. A method of printing carbonless forms comprises providing a recording sheet comprising a substrate, the substrate being coated with a coated front (CF) coating comprising a developer, hollow microspheres and a binder composition, wherein the binder composition comprises polyvinyl alcohol and printing on the recording sheet with an electrostatic printer or copier.

20 Claims, No Drawings

COPYABLE CARBONLESS PAPER

CROSS-REFERENCE TO RELATED APPLICATIONS

This application claims the benefit of U.S. provisional application Serial No. 60/145,406, filed Jul. 23, 1999, the entire disclosure of which is incorporated herein by reference.

The present invention relates to carbonless copy paper, and more specifically to a carbonless CF recording sheet capable of being run on electrostatic copiers and printers without contaminating the components of the electrostatic device.

BACKGROUND

Carbonless copy systems and other copying systems employing a color precursor and a developer are well known in the art. These systems can comprise two sheets, a transfer or donor sheet which contains a colorless color-forming agent on one of its surfaces which is often contained in pressure rupturable microcapsules and a developer or receiver sheet, which is typically a substrate having a layer of a developer material coated onto its front surface which can react with the colorless color-forming agent to form a visible image. In practice, to produce an image, the two sheets are juxtaposed so that the colorless color-forming agent faces the developer material. Upon the application of pressure, such as a pen, pencil, typewriter, or other writing instrument, the microcapsules are ruptured which releases the colorless color-forming agent. The color-forming agent reacts with the developer material on the developer sheet to form a visible image.

Carbonless papers are widely used in the forms industry. Typically, preprinted forms are compiled into a set or packet such that marking the top form will provide the required number of duplicates. In one instance, the carbonless paper is prepared in precollated sets wherein sheets of various colors and surfaces are packaged in reversed sequence sets wherein the sheets are arranged opposite to their normal functional order. That is, the CF sheet is first in the set with the CB sheet being last, with the required number of CFB sheets therebetween. When the sheets are then printed in a printer which automatically reverses their sequence in the delivery tray, they will end up in the proper functional order for subsequent data entry. Where reversal of the sequence in the delivery tray does not occur, precollated sheets can be arranged in their normal functional order.

Traditionally, carbonless paper forms have been printed by conventional printing techniques, such as offset lithography, etc. With the advent of high speed electrostatic copiers having dependable, high capacity collating systems, has come the natural attempts to print carbonless paper by such techniques. Such attempts initially encountered problems, because the specialty coatings on the sheet would tend to shear or pick off the sheet resulting in contamination of the electrostatic device. Cost prohibitive maintenance to clean the machine on a frequent basis was necessary for satisfactory operation of the copier and production of an acceptable product. The heat and pressure utilized in the electrostatic devices would cause transfer of the coating components to elements of the paper and toner transport systems in the electrostatic device. After a number of sheets were printed, the contamination in the device would cause specks of toner powder to be deposited on the sheet. Many of these aforementioned problems were attributable to the microcapsule coating on the CB sheet. Reformulation and modification of the CB coating resolved many of these problems relating to contamination from the microcapsules and the inadvertent rupture thereof which caused premature release of the encapsulated contents and contamination of the electrostatic device.

Contamination of electrostatic copiers and printers has again become problematic due to changes in the feed and printing mechanisms in recently developed electrostatic devices. The new machines are believed to subject the paper being printed to increased levels of heat and pressure not previously encountered during the electrostatic printing process. The increased heat and pressure as well as the faster speeds associated with the newer devices are believed to be responsible for the current contamination problems encountered when using prior art carbonless systems.

Applicants have discovered that the contamination with the newer electrostatic devices is originating with the CF coating rather than the CB coating. As the CF sheet is fed through the paper transport system of the printer or copier, it encounters various pressure points in the device, such as, for example, feed belts and wheels, retard rollers, pinch rollers and the like. When the sheet is passed through these points, often under elevated temperatures, there is intimate contact between the pressure point and the sheet which can result in contamination of the device with components of the CF coating and have deleterious effects on the continued operation of the printer or copier. Simply increasing the amount of binder in the CF formulation may improve binding of the various CF components and thereby reduce contamination. However, an increase in binder levels typically results in a corresponding decrease in product performance characteristics, such as intensity.

Accordingly, there is a need for a carbonless paper capable of being printed on an electrostatic copier or printer without excessive contamination; a paper capable of being run on a copier or printer without requiring excessive machine maintenance; and a carbonless paper, and in particular a recording paper, having improved binding power to prevent contamination without adversely affecting imaging properties. There is also a need for a method of producing a carbonless form using an electrostatic printer or copier wherein the carbonless paper will not contaminate the components of the device and excessive maintenance is not required.

SUMMARY

This invention provides an improved carbonless copy paper, and in particular an improved carbonless CF recording sheet which is capable of being printed on an electrostatic copier or printer without excessive contamination and without requiring excessive maintenance to enable continued operation of the printer or copier. It has been found that, in accordance with the invention, the binder portion of the CF coating can be increased without adversely affecting imaging properties. In accordance with a preferred embodiment of the invention, polyvinyl alcohol mixed with latex is used to improve binding of the pigments in the CF coating while avoiding film formation which can be detrimental to image intensity and speed of development. In another preferred embodiment, an improved binder based on PVA and starch prepared as a cooked pre-mix is used to provide improved binding of the CF coating without adversely affecting imaging properties.

DESCRIPTION

In describing the preferred embodiment, certain terminology will be utilized for the sake of clarity. It is intended that such terminology include not only the recited embodiments but all technical equivalents which operate in a similar manner, for a similar purpose, to achieve a similar result.

The recording sheet of the present invention may be used in any imaging system in which a color precursor is reacted with a developer to form an image. More particularly, it may be used in pressure-sensitive transfer recording systems, pressure-sensitive self-contained recording systems, and thermal or heat-sensitive recording systems.

In accordance with another embodiment, the recording sheet of the present invention may be used in a photosensitive recording system. Photosensitive compositions, photoinitiators, color formers, wall formers, encapsulation techniques and developer materials useful in photosensitive recording systems are described in U.S. Pat. Nos. 4,399,209; 4,772,530; and 4,772,541 are useful herein. These patents are incorporated herein by reference.

The recording sheet includes a substrate having a front surface and a back surface. The substrate is typically paper but in certain applications it may be made of transparent polymeric materials such as polyethylene terephthalate, translucent substrates, opaque polymeric substrates such as Melinex 329 and Melinex 470 sold by ICI Americas, or polymer coated paper materials such as commercially available photographic papers and plain paper.

Any of the developer materials that have been conventionally used or taught for use in any of the aforesaid recording systems should be useful in the recording sheets of this invention. The developer material is selected such that it reacts with the color precursor to produce a high density image. In the most typical embodiments, the color precursor is a substantially colorless electron donating compound of the type conventionally used in the pressure-sensitive recording art and the developer material is a solid particulate electron accepting compound.

The developer can be selected from among the developers conventionally used in carbonless paper including acid clay, active clay, attapulgite, etc.; organic acids such as tannic acid, gallic acid, propylgallate; aromatic carboxylic acids such as benzoic acid, p-tert-butyl-benzoic acid, 4-methyl-3-nitro- benzoic acid, salicylic acid, 3-phenyl salicylic acid, 3-cyclohexyl salicylic acid, 3-tert-butyl-5-methyl salicylic acid, 3,5-ditert-butyl salicylic acid, 3-methyl-5-benzyl salicylic acid, 3-phenyl-5-(α,α-dimethylbenzyl)salicylic acid, 3-cyclohexyl-5-(α,α-dimethylbenzyl)salicylic acid, 3-(α,α-dimethylbenzyl)-5-methyl salicylic acid, 3,5-dicyclohexyl salicylic acid, 3,5-di-(α-methylbenzyl)salicylic acid, 3,5-di-(α,α-dimethylbenzyl)salicylic acid, 3-(α-methylbenzyl)-5-(α,α-dimethylbenzyl)salicylic acid, 4-methyl-5-cyclohexyl salicylic acid, 2-hydroxy-1-benzyl-3-naphthoic acid, 1-benzoyl-2-hydroxy-3-naphthoic acid, 3-hydroxy-5-cyclohexyl-2-naphthoic acid and the like, and polyvalent metallic salts thereof such as zinc salts, aluminum salts, magnesium salts, calcium salts and cobalt salts as disclosed in U.S. Pat. Nos. 3,864,146; 3,924,027 and 3,983,292; phenol compounds such as 6,6'-methylene-bis(4-chloro-m-cresol) as disclosed in Japanese Patent Publications 9,309 of 1965 and 20,144 of 1967, and Japanese Laid Open Patent Publication No. 14,409 of 1973; acid polymers such as maleic acid-rosin resin and copolymers of maleic anhydride with styrene, ethylene or vinylmethylether; and aromatic carboxylic acid-aldehyde polymers, aromatic carboxylic acid-acetylene polymers and their polyvalent metallic salts as disclosed in U.S. Pat. Nos. 3,767,449 and 3,772,052.

Preferred developer materials are phenolic resins, such as phenol-aldehyde resins e.g., p-phenyl-phenolformaldehyde resin; phenol-acetylene resins, e.g., p-tert-butylphenol-acetylene resin; polyvalent metallic salts thereof such as zinc modified phenol formaldehyde resin as disclosed in U.S. Pat. No. 3,732,120, and phenolic resins modified to include amounts of unsubstituted or substituted salicylic acids in a manner known in the art. One class of phenolic resin useful in the present invention is the product of oxidative coupling of substituted or unsubstituted phenols or bisphenols. Oxidative coupling may be catalyzed by various catalysts but a particularly desirable catalyst is the enzyme peroxidase. Particularly desirable developers are the resins described in commonly assigned U.S. Pat. No. 4,647,952, which is incorporated herein by reference, and more particularly the product of oxidative coupling of bisphenol A.

Especially preferred developer materials are phenol-formaldehyde condensation products. More particularly, alkylphenolic resins and, still more particularly, metallated products of alkylphenolic resins are preferred. The alkyl phenols are monosubstituted by an alkyl group which may contain 1 to 12 carbon atoms. Examples of alkyl phenols are ortho- or para- substituted ethylphenol, propylphenol, butylphenol, amylphenol, hexylphenol, heptylphenol, octylphenol, nonylphenol, t-butylphenol, t-octylphenol, etc. Another class of thermoplastic developer material which may be used within the scope of the present invention is a resin-like condensation product of a polyvalent metal salt, such as a zinc salt, and a phenol, a phenol-formaldehyde condensation product, or a phenol-salicylic acid-formaldehyde condensation product.

Useful phenolic developer resins are available from Schenectady Chemical Co. under the designations HRJ 2629, BRJ 2969, HRJ 4250 and HRJ 4542. The latter two products are reported to be a metallated condensation product of an ortho- or para-substituted alkylphenol, a substituted salicylic acid, and formaldehyde.

A binder is used to improve the scuff resistance of the recording layer and to provide adequate adhesion between the coating and the substrate. The amount of binder used in the composition will vary depending upon the nature of the binder material. In accordance with the present invention, the amount of binder used is determined based on the amount necessary to securely anchor the components of the recording coating to the sheet in order to avoid contamination without adversely affecting imaging properties. The total binder content typically will fall within the range of about 2 to 30% and more typically about 8 to 20% based on solids.

A binder used in the present invention is mixed with the developer resin to form a developer coating. The binder acts to enhance the surface strength of the coating as well as to adhere the coating to the substrate. In a preferred embodiment, a strong synthetic binder, such as polyvinyl alcohol, is used to provide enhanced binding strength. Additional synthetic and/or natural binders can also be added. Synthetic binders are typically preferred because they are stronger than natural binders and the surface strength of the developer sheet can be maintained without affecting image development. Illustrative examples of other synthetic binders which can be used include polyvinyl acetate and copolymers thereof, styrene butadiene rubber (SBR), polystyrene, butadiene-styrene copolymers, polyvinylpyrrolidone, acrylic homo- or copolymers such as acrylic or methacrylic acids or lower alkyl esters thereof, e.g., ethyl acrylate, butyl acrylate and methyl methacrylate, acrylamide and the like. Especially preferred synthetic binders are latexes such as sytrenebutadiene latexes, carboxylated sytrenebutadiene latexes, acrylic latexes, and acrylonitrile latexes. Latex binders, when present, typically fall within the range of about 2 to 10% and more typically 3 to 6% by dry weight of the coating composition. One example of a commercially available latex useful in the present invention is sold under the trade designation Genflo Latex 5100 from Omnova. Illustrative examples of natural binders are gum arabic, casein, sodium alginate, methyl cellulose, carboxymethyl cellulose, dextrin, starch or modified starches, e.g., oxidized, hydrolyzed or hydroxyethylated starch, and the like.

The microspheres used in the present invention are hollow spherical pigment particles made from a synthetic organic polymer or any inorganic shell-forming material such as glass or sodium silicate. Typically such microspheres have a diameter of approximately 0.3$\mu$ to 15$\mu$ and preferably about 1.0 micron. Such hollow synthetic organic pigment particles are known in the art and are commercially available from Rohm and Haas Corp. The microspheres provide a network of gas-filled voids in the developer layer. Furthermore, it is believed that the microspheres help to prevent the binder from forming a film on the surface of the sheet. One example of a commercially available microspheres that is useful in the present invention is sold under the trade designation HP-1055 from Rohm and Haas. Hollow polymer particles which are useful in this invention may be made in accordance with and having the properties disclosed in U.S. Pat. Nos. 3,784,391; 4,798,691; 4,908,271; 4,910,229; and 4,972,000; and Japanese Patent Applications 60/223873; 61/62510; 61/66710; 61/86941; 62/127336; 62/156387; 01/185311; and 02/140272; U.S. Pat Nos. 4,427,836;4,469, 825; 4,594,363; and 4,880,842. The disclosures therein related to the manufacture and composition of the hollow polymer particles are incorporated herein by reference. The preferred pigment has a soft compressible quality that yields a microscopic void under the application of writing or marking pressure.

The recording layer may also include in the coating solution a viscosity increasing additive, typically a water-soluble material, which significantly increases the viscosity of the coating layer upon removal of the coating solvent. Further optionally incorporated with the thermoplastic developer material is one or more dispersing agents (e.g., Dispex N-40, polymeric carboxylic acid from Allied Colloids, Inc.). Other commonly utilized additives such as anti-foaming agents, structured clays (e.g., Exsilon 87 and Ansilex 93 from Englehard Corp., as described in U.S. Pat. No. 5,350,729 to Londo et al.), optical whitening agents (e.g., Tinopal PT-150 from Ciba Geigy Corp.) and lubricants (e.g., Nopcote C-105HS calcium stearate dispersion from Henkel Corp.) may also be added in minor amounts.

To produce the recording sheet, the developer material is dispersed in a liquid, typically water, to form a resin dispersion, and binder material, microspheres, and optional additives are mixed into the dispersion. Once the dispersion is well mixed, it is coated onto the support by coating means known in the art. For example, a Meyer bar coater may be used. In practice, the developer layer is applied in an amount of about 1.0 to 2.0 pounds per 1700 sq. ft.

The developer resin is used in an amount sufficient to react with a color precursor and form as image. In a preferred embodiment, the developer layer contains about 4 to 40% developer and about 5 to 50 wt. % microspheres. Preferably, the amount of developer resin used is about 10% to 25% and the amount of microspheres is about 7 to 20% based on dry weight.

In accordance with the invention, binder levels of the recording layer are increased such that the coatings can be run for extended periods of time on an electrostatic printer or copier without excessive contamination or downtime for maintenance. In a preferred embodiment, polyvinyl alcohol (PVA) is added at elevated levels to better hold the pigments in the recording layer coating. The amount of PVA on a dry basis typically is between 2 and 12%, preferably between 4 and 9%. In the preferred embodiment, the polyvinyl alcohol is cooked with a starch to prepare a pre-mix which is then used to prepare a CF recording layer coating composition in accordance with the present invention. The amount of starch used typically is about 2 to 25%, preferably about 4 to 20% based on dry weight.

One embodiment of the present invention is a developer sheet which minimizes contamination in electrostatic printers or copiers and yet also provides improved image intensity through one or a combination of mechanisms. Although not wishing to be bound by theory, applicants believe that the starch-PVA pre-mix prevents formation of a PVA barrier film which otherwise would interfere with imaging capabilities of the carbonless form. By avoiding the formation of a film, the starch-PVA pre-mix facilitates penetration of the color oil (from ruptured CB microcapsules) into the developer layer and into contact with the color developing resin, thereby forming an image.

The present invention also provides a method for printing carbonless forms on an electrostatic printer or copier which comprises providing a recording sheet having a developer and a binder, wherein the binder comprises one or more synthetic binders, preferably a combination of polyvinyl alcohol and latex, and printing on the recording sheet with an electrostatic printer or copier. Carbonless forms printed in accordance with the present invention can be run sequentially for an extended period of time without causing contamination of the electrostatic printer or copier. The method of the invention avoids expensive printer downtime for cleaning typically required for electrostatic printing of conventional carbonless.

The present invention is also directed to a process for electrostatically printing carbonless sheets and producing a carbonless formset. The carbonless formset contains a plurality of sheets, including at least a first substrate containing a coating of an encapsulated color former and a second substrate containing a second coating of a color developer. The first and second substrates are positioned such that the first and second coatings are juxtaposed. The second coating comprises a color developer in a binder matrix of polyvinyl alcohol and latex. Formsets are produced by applying adhesive to the formset sheets after the sheets have been printed on the electrostatic copier or printer, such that the first and second substrates are collated as a set. Formsets of three plies or more can be prepared by providing one or more CFB sheets between the first (CB) and second (CF) substrates.

The present invention is illustrated in more detail by the following non-limiting examples.

As shown in the following table, recording sheets prepared in accordance with the present invention can successfully be processed on an electrostatic printer or copier without causing excessive contamination to the components of the device and yet still provide improved imaging capabilities. Developer coating compositions were prepared using the binder, developer resin, plastic pigment and other additives (combined mix) identified in Table 1. The three formulations represent a prior art control and two formulations (YE and YC) representative of the present invention. In general, the developer coatings were prepared by adding, with mixing, the components in the order listed. The PVA was cooked at about 90° C. for approximately 30 minutes before being added to the mix. Similarly, in the YE formulation, PVA and starch were cooked together at about 90° C. for approximately 30 minutes to form a pre-mix which was then added to the batch in process. The compositions were formulated as aqueous dispersions at a solids content compatible with the applicable coating method, as is known in the art. The compositions were coated on a standard basestock according to conventional coating procedures. Imaging and processing properties of the samples were determined in accordance with the following test procedures.

Two types of imaging tests were used to evaluate the coated specimens. These are referred to in the accompanying table as Smudge and Intensity. For both tests the intensities of the resulting images were reported (in percent) as the ratio of light reflected from the imaged area versus the unimaged (background) area. Thus, the more intense or darker images appear as lower values, and the higher values indicate weak or faint images.

The coated specimens were also tested on a Xerox printer to determine the propensity of the samples to cause contamination in the printer. The specimens were processed through the printer and the point at which contamination was observed on the fuser roll pad was recorded as the run length. Accordingly, specimens having longer run lengths are less likely to cause contamination in the electrostatic printers.

The nature of each testing procedure may be described as follows.

Smudge: The CF recording sheet is dragged across the mated CIB sheet for a prescribed distance, while under a prescribed pressure loading. The resulting discoloration (image) is measured after ten minutes development time. The higher the Smudge value the better the result.

Calender Intensity: The sheet couples are passed one time through the nip formed by a pair of steel calender rolls. The reflectance of each imaged area was measured after two minutes. The lower the intensity value the better the result.

Run Length: 8½"×11" samples are run through a Xerox printer/copier until contamination is noted. Longer run lengths indicate better performance of the test sample.

The reported test values may be expressed mathematically as follows:

Smudge=$(R_i/R_o)(100)$, and

Intensity=$(R_i/R_o)(100)$, where $R_i$ is the average reflectance of the imaged area of the respective test, and, $R_o$ is the average reflectance of the unimaged area of the specimen.

TABLE 1

| | PRIOR ART | INVENTION | |
|---|---|---|---|
| | CONTROL | YE | YC |
| MATERIAL | | | |
| Genflo Latex 5100 | 8.0% | 4.0% | 5.0% |
| PVA, Airvol 107 | — | 7.5 | 7.5 |
| Pencote starch | 8.1 | — | — |
| Starch, Penford 380 | — | 4.0 | — |
| Exsilon Clay | 51.7 | 40.2 | 42.5 |
| Ansilex Clay | 17.2 | 13.4 | 14.1 |
| Hollow plastic spheres | — | 10.0 | 10.0 |

TABLE 1-continued

| | PRIOR ART | INVENTION | |
|---|---|---|---|
| | CONTROL | YE | YC |
| HRJ 2629 Resin | 13.7 | 18.0 | 18.0 |
| Dispex N-40 | 1.3 | 1.7 | 1.7 |
| Tinopal | — | 1.2 | 1.2 |
| Total | 100.0% | 100.0% | 100.0% |
| TEST DATA | | | |
| Intensity | 55 | 47 | 45 |
| Smudge | 88 | 87 | 84 |
| Run length on Xerox before failure | 29K sheets | >50K sheets | >50K sheets |

The samples produced in accordance with the invention provided significantly improved performance on the copier, improved intensity and approximately equivalent smudge compared to the prior art control samples.

Having described the invention in detail, it will be apparent that modifications and variations are possible without departing from the scope of the invention defined in the appended claims.

What is claimed is:

1. A method for printing carbonless forms on an electrostatic printer or copier which comprises:

providing a recording sheet comprising a substrate, said substrate being coated with a coated front (CF) coating comprising a developer, hollow microspheres and a binder composition, wherein the binder composition comprises polyvinyl alcohol; and printing on the recording sheet with an electrostatic printer or copier.

2. The method of claim 1 wherein said binder composition further comprises at least one other binder material.

3. The method of claim 2 wherein said binder composition further comprises a synthetic binder selected from the group consisting of polyvinyl acetate and copolymers thereof, styrene butadiene rubber (SBR), polystyrene, butadiene-styrene copolymers, polyvinylpyrrolidone, ethyl acrylate, butyl acrylate, methyl methacrylate, acrylamide and mixtures thereof.

4. The method of claim 2 wherein said binder composition further comprises a latex binder selected from the group consisting of sytrenebutadiene latexes, carboxylated sytrenebutadiene latexes, acrylic latexes, and acrylonitrile latexes.

5. The method of claim 4 wherein said latex is a sytrenebutadiene latex.

6. The method of claim 1 wherein said binder composition comprises from about 2 to 30 percent by dry weight of the CF coating.

7. The method of claim 1 wherein said CF coating comprises from about 2 to 12 percent by dry weight polyvinyl alcohol.

8. The method of claim 7 wherein said binder composition further comprises a styrenebutadiene latex.

9. The method of claim 8 wherein said binder composition further comprises a starch binder.

10. The method of claim 1 wherein said microspheres have a diameter from about 0.3$\mu$ to 15$\mu$.

11. The method of claim 1 wherein said developer is a phenolic resin.

12. The method of claim 11 wherein said phenolic resin is a zincated phenolic resin.

13. The method of claim 1 wherein said substrate is paper or a polymeric material.

14. The method of claim 13 wherein said substrate is polyethylene terephthalate.

15. A process for electrostatically printing carbonless sheets and producing a carbonless formset comprising:

providing a plurality of carbonless sheets, including at least a first substrate containing a coating of an encapsulated color former and a second substrate containing a second coating comprising a color developer in a binder matrix of polyvinyl alcohol and latex, wherein the first and second substrates are positioned such that the first and second coatings are juxtaposed;

printing said sheets on an electrostatic copier or printer; and applying adhesive to the formset sheets after the sheets have been printed on the electrostatic copier or printer thereby forming a collated formset wherein a coating containing an encapsulated color former is in contact with a coating containing a color former.

16. The process of claim 15 wherein said carbonless formset further comprises at least one intermediate sheet containing a coating of an encapsulated color former on one surface and a coating comprising a color developer in a binder matrix of polyvinyl alcohol and latex on the other surface.

17. A method for printing carbonless forms on an electrostatic printer or copier which comprises:

providing a recording sheet comprising a substrate, said substrate being coated with a coated front (CF) coating comprising from about 4 to 40% by dry weight of a developer, from about 5 to 50% by dry weight hollow microspheres and from about 2 to 30% by dry weight of a binder composition, wherein the binder composition comprises polyvinyl alcohol and a latex binder, said polyvinyl alcohol being from about 2 to 12% and said latex binder being from about 2 to 10% by dry weight of said CF coating composition; and printing on the recording sheet with an electrostatic printer or copier.

18. The method of claim 17 wherein said CF coating composition comprises from about 10 to 25% developer, from about 7 to 20% microspheres, from about 4 to 9% polyvinyl alcohol and from about 3 to 6% latex binder based on dry weight of said CF coating composition.

19. The method of claim 17 wherein said CF coating composition further comprises from about 2 to 25% starch.

20. The method of claim 19 wherein said CF coating composition comprises from about 4 to 20% starch.

* * * * *